United States Patent [19]

Chacin U. et al.

[11] Patent Number: 5,062,480

[45] Date of Patent: Nov. 5, 1991

[54] SELF ACTUATED INTAKE VALVE ASSEMBLY FOR INSERT SUBSURFACE RECIPROCATING PUMPS

[75] Inventors: Jesus E. Chacin U., Caracas; Amnon M. Vadasz F., Urb. Club de Campo, both of Venezuela

[73] Assignee: Intevep, S.A., Caracas, Venezuela

[21] Appl. No.: 597,203

[22] Filed: Oct. 11, 1990

[51] Int. Cl.[5] ..... E21B 43/16; F04B 21/06

[52] U.S. Cl. ..... 166/108; 166/105; 166/332; 166/333; 417/448

[58] Field of Search ..... 166/68, 105, 106, 107–112, 166/332, 333; 417/448, 449, 450, 554

[56] References Cited

U.S. PATENT DOCUMENTS 1,192,791 7/1916 Krogh ..... 417/450
3,034,440 5/1962 Hermanson ..... 417/448 X
4,776,401 10/1988 Dollison ..... 166/108 X

FOREIGN PATENT DOCUMENTS 899866 1/1982 U.S.S.R. ..... 166/106
1059252 12/1983 U.S.S.R. ..... 417/448

*Primary Examiner*—Hoang C. Dang
*Attorney, Agent, or Firm*—Bachman & LaPointe

[57] ABSTRACT

The present invention is drawn to an inlet valve assembly for a subsurface sucker rod operated reciprocating piston pump and, more particularly an inlet valve assembly which is locked in its closed position when the pump is in its unanchored, non-pumping position within the production tube of a deep well. When the subsurface piston pump is anchored within the production tube of the deep well of the inlet valve assembly is freely movable between open and close positions upon reciprocation of the piston.

9 Claims, 6 Drawing Sheets

SELF ACTUATED INTAKE VALVE ASSEMBLY FOR INSERT SUBSURFACE RECIPROCATING PUMPS

BACKGROUND OF THE INVENTION

The present invention is drawn to an improved inlet valve assembly for use in subsurface sucker rod operated reciprocating piston pumps used in the petroleum industry for pumping oil from a downhole well to the surface.

Typically, subsurface sucker rod operated reciprocating piston pumps comprise a pump barrel having any inlet check valve and an outlet check valve and a pump plunger which is reciprocated within the barrel via a sucker rod. The intake valve is generally located at the entrance to the pump barrel and allows for the flow of well fluids into the pump barrel. The discharge valve is commonly located in the plunger and permits the flow of well fluids out of the pump barrel and up to the surface. Upon reciprocation of the pump plunger by the sucker rod, the coordinated action of both the intake valve and the discharge valve results in fluid flow from the well to the surface.

In order for the reciprocating piston pumps to operate properly they must be anchored within the production tube of the deep well. Thus, during normal pumping operations from the well the reciprocating piston pump is anchored within the production tube. However, during well maintenance, repair and stimulation operations, such as, steam injection or diluent injection, it is necessary to stop the normal pumping operation and to remove the subsurface reciprocating pump from its anchored position in the production tube as no fluids could flow down through the pump when in its anchored position. While the pump must be unanchored in order to carry out fluid injection and the like as aforesaid, it is highly desirable that the reciprocating piston pump remain within the production tube in order to avoid the cost and lost time associated with bringing the subsurface reciprocating pump and sucker rod string to the surface during the aforesaid operations. Accordingly, it is common practice in the prior art to unanchor the subsurface reciprocating pump by pulling the sucker rod string from the surface and move the pump a short distance from its anchored position to an enlarged section of the production tube. In this position, specific fluids from the surface can be injected downhole into the well for maintenance, repair and recovery stimulation.

During the injection of the aforesaid fluids into the well it is extremely important not allow any flow through the pump barrel of the subsurface reciprocating pump as the fluids being injected generally carry particles which are known to damage the pump plunger and pump barrel surfaces. Accordingly, in existing systems one must choose between removing the reciprocating pump entirely from the production tube or suffer the consequences of passing a portion of the aforesaid injected fluid through the pump barrel of the pump thus resulting in the aforesaid damage to same.

Naturally, it would be highly desirable to provide a system wherein the reciprocating piston pump may be maintained in the production tube of a downhole well and at the same time insure that no fluids which would damage the pump will pass through the pump during the maintenance, repair and stimulation operations as set forth above.

Accordingly, it is the principal object of the present invention to provide an improved inlet valve assembly for use in subsurface sucker rod operated reciprocating piston pumps.

It is a particular object of the present invention to provide an intake valve assembly as aforesaid wherein the inlet valve to the reciprocating piston pump is locked in its closed position when the pump is in its unanchored, non-pumping position within the production tube of a deep well.

It is a further object of the present invention to provide an inlet valve assembly as aforesaid wherein the inlet valve is freely moveable between its open and closed position when anchored within the production tube of the deep well for pumping fluid from the well to the surface. It is a further object of the present invention to provide an inlet valve assembly as aforesaid which is effective in service and relatively inexpensive to manufacture.

Further objects and advantages of the present invention will appear hereinbelow.

SUMMARY OF THE INVENTION

In accordance with the present invention the foregoing objects and advantages readily obtained.

The present invention is drawn to an improved inlet valve assembly for use in combination with a sucker rod operated reciprocating subsurface pump which is disposed within the production tube of a deep well for pumping oil from the well to the surface. In accordance with the present invention the sucker rod operated reciprocating subsurface pump is selectively positioned between a first position wherein the pump is anchored in the production tube for pumping fluid from the well and a second position wherein said pump is unanchored in said production tube for non-pumping operations such as maintenance, repair and recovery stimulation operations. The reciprocating subsurface pump comprises a pump barrel having a first valve seat defining an inlet to the pump barrel and a second valve seat defining an outlet port from the valve barrel. An inlet valve is provided for selectively sealing the inlet port by seating on a surface of the first valve seat. Likewise, an outlet valve is provided for selectively sealing the outlet port from the valve barrel. A pump plunger is mounted for reciprocal movement via a sucker rod within the pump barrel for pumping fluid from the inlet port to the outlet port when the pump is anchored in the production tube. In accordance with the present invention the inlet valve of the present invention includes means for locking the inlet valve against the inlet port for sealing same against pressure downhole in the well when the pump is in its second unanchored position so as to prohibit passage of fluid into the pump barrel. The inlet valve further includes means for unlocking the inlet valve so as to allow for selective sealing and unsealing of the inlet port to the pump barrel when the pump is in its first anchored position for pumping fluid from the well.

In one preferred embodiment of the present invention the mechanism for locking the inlet valve includes a mechanical biasing mechanism which biases the inlet valve against the inlet port. In a further embodiment the mechanism for locking the inlet valve against the inlet port includes a flow control mechanism for sealing off the flow of fluid to the inlet port and accordingly the inlet valve of the subsurface pump.

By providing an arrangement as aforesaid the sucker rod operated reciprocating subsurface pump may be maintained within the production tube when in its unanchored position without fear of fluid passing through the inlet valve and through the pump barrel and damaging same.

DETAILED DESCRIPTION

Figure 1:
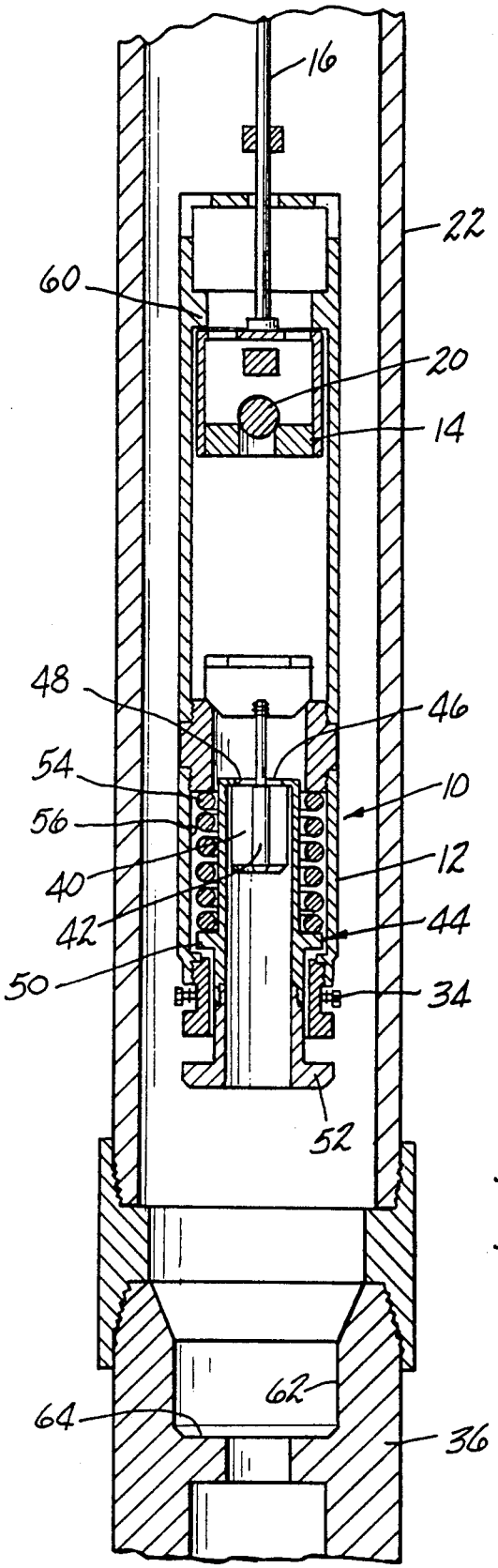
FIG. 1 is a partial sectional view of a deep well pump assembly in its unanchored position in the production tube and illustrating an inlet valve of the present invention in its locked position.
Figure 2:
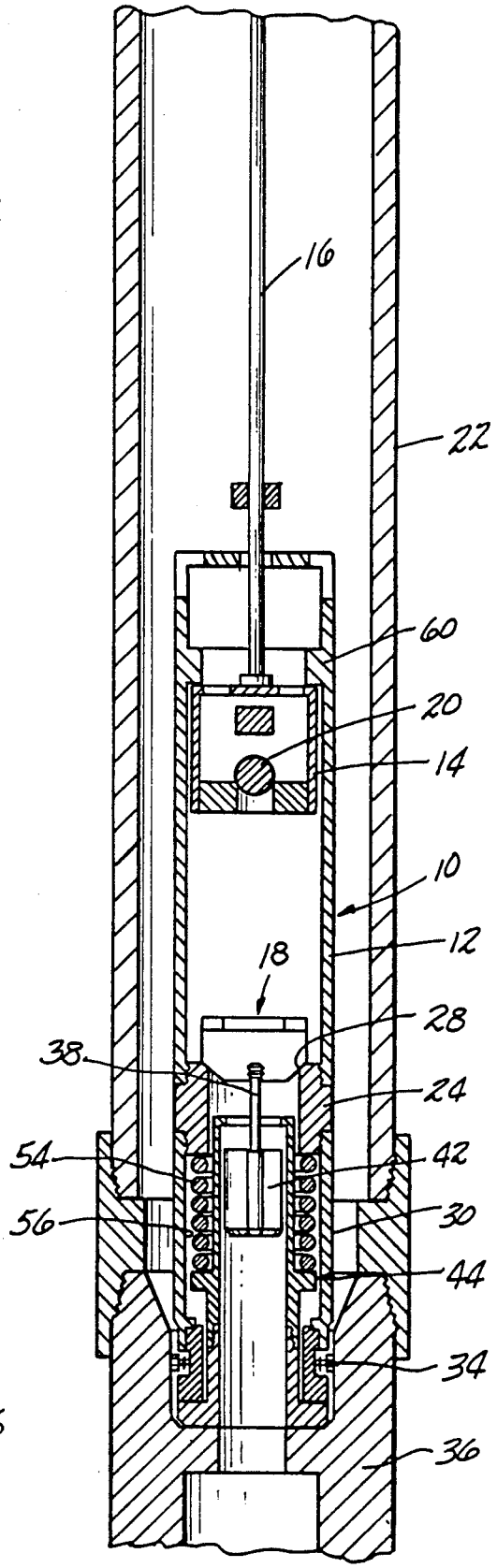
FIG. 2 is a partial cross sectional view similar to FIG. 1 showing the subsurface pump in its anchored position within the production tube wherein the inlet valve is free to move between its open and closed positions.
Figure 3:
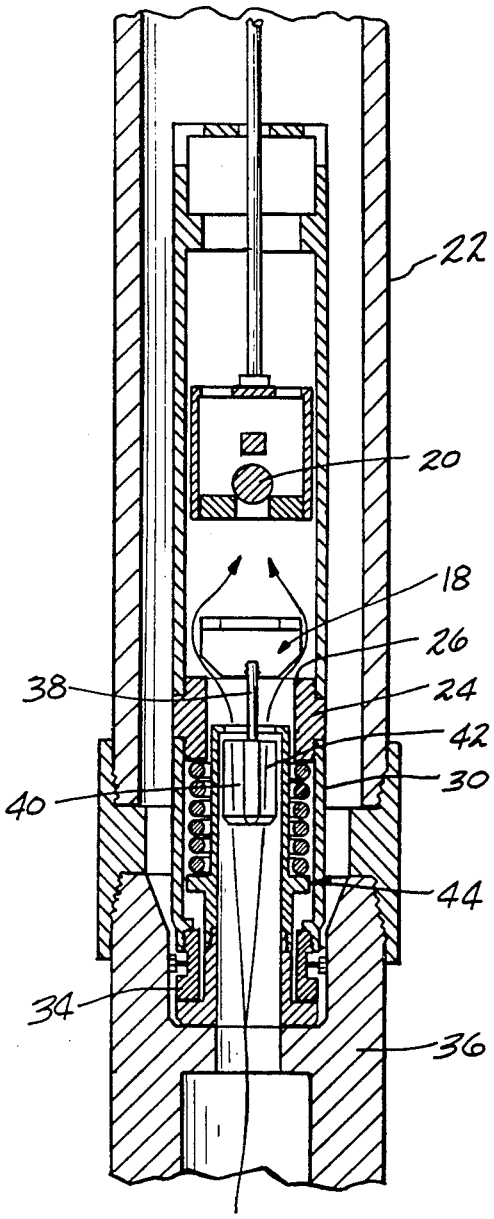
FIG. 3 is a partial cross sectional view similar to FIG. 2 showing the position of the inlet valve of the present invention on the upstroke of the plunger.

With reference to the drawings and, more particularly, FIGS. 1 through 4 there is illustrated a sucker rod operated reciprocating subsurface pump located within the production tube of a deep well. The reciprocating subsurface pump 10 comprises a pump barrel 12 having a piston 14 mounted therein for reciprocal movement via sucker rod 16. As can be seen in FIG. 3, the pump barrel 12 is provided with an inlet valve assembly 18 for drawing fluid into the pump barrel during the upward stroke of the pump piston 14 via the sucker rod 12. The pump piston 14 carries a discharge valve 20 which, as can best be seen in FIG. 4, opens for passing fluid from the pump barrel and up the well production tube 22 on the downward stroke of the pump piston 14.

In accordance with the present invention a first embodiment of inlet valve assembly 18 is illustrated in FIGS. 1 through 4. The inlet valve assembly includes a valve seat 24 formed within the pump barrel and defining a sealing surface 26 upon which valve sealing element 28 seals when the valve 18 is in its closed position. The assembly further includes an extension portion 30 which extends from the valve seat 24 upstream of valve sealing element 28. Portion 30 has either integrally therewith or secured thereto a sealing portion 32 provided with a seal or friction ring 34 for sealing the extension and therefor the pump barrel in seating nipple 36 in a manner to be described in more detail hereinbelow. In accordance with the embodiment of inlet valve of the present invention as illustrated in FIGS. 1 through 4, a connection portion 38 extends from the sealing element 28 and connects to a vane guide member 40 which consists of, for example, four vane members 42 located 90 degrees apart with respect to the axis of the connecting element 38.

As can be seen most clearly in FIG. 1, a locking member 44 in the form of a hollow substantially cylindrical tube is mounted within extension portion 30 and 32. The locking member includes a bore 46 defined by radial flange 48. The connecting portion 38 of the valve 18 penetrates the bore 46. The vanes 42 of valve portion 40 abut radial flange 48 as shown in FIG. 1. The locking mechanism 44 has an annular rib 50 located intermediate the ends of the locking mechanism. The end of the locking mechanism 44 opposite radial flange 48 is provided with a flange 52 which abuts the locking nipple 36 when the pump is in its anchored position within the production tube 22 in a manner to be discussed in greater detail hereinbelow. A coil spring 54 is provided in an annular chamber 56 defined by extension portion 30 and locking mechanism 44. The coil spring contacts the underside of valve seat 24 and biases against annular rib 50 on locking mechanism 44 for biasing the locking mechanism downward. As can be seen in FIG. 1, the coil spring 54 biases the locking mechanism 44 downward so that radial flange 48 abuts the vanes 42 of vane guide portion 40 of valve 18. In turn, the valve sealing element 28 is likewised carried by the locking mechanism 44 downward so as to lock the valve sealing element 28 against the sealing surface 26 of valve seat 24.

With further reference to FIGS. 1 through 4 the operation of the inlet valve assembly and sucker rod operated reciprocating subsurface pump will be described in detail. As noted above, when the well is being serviced and no pumping is being carried out by the reciprocating subsurface pump, it is desirable to maintain the pump within the well tube in an unanchored position. The unanchored position of the pump within the well tube 22 is illustrated in FIG. 1. As illustrated in FIG. 1 the pump barrel 12 is held in this position by the sucker rod 16 which is connected to piston 14. The piston 14 abuts an annular abutment 60 provided on the pump barrel. In this manner the pump 10 is suspended within the well tube. In order to prohibit the flow of fluid into the pump barrel 12 when in its unanchored suspended position, valve sealing element 28 is held against the sealing surface 26 of the valve seat 24 by locking member 44 which is biased downwardly by coil spring 54. The locking mechanism 44 abuts valve portion 40 and assures that the valve sealing element 28 seals on the valve seat 24. In this manner fluids are prohibited from flowing into the valve barrel. The biasing force of the coil spring 54 is selected in order to insure that the valve remains in its sealed position against the pressures which will be created downhole in the well during servicing, maintenance and the injection of fluids for well stimulation.

Figure 4:
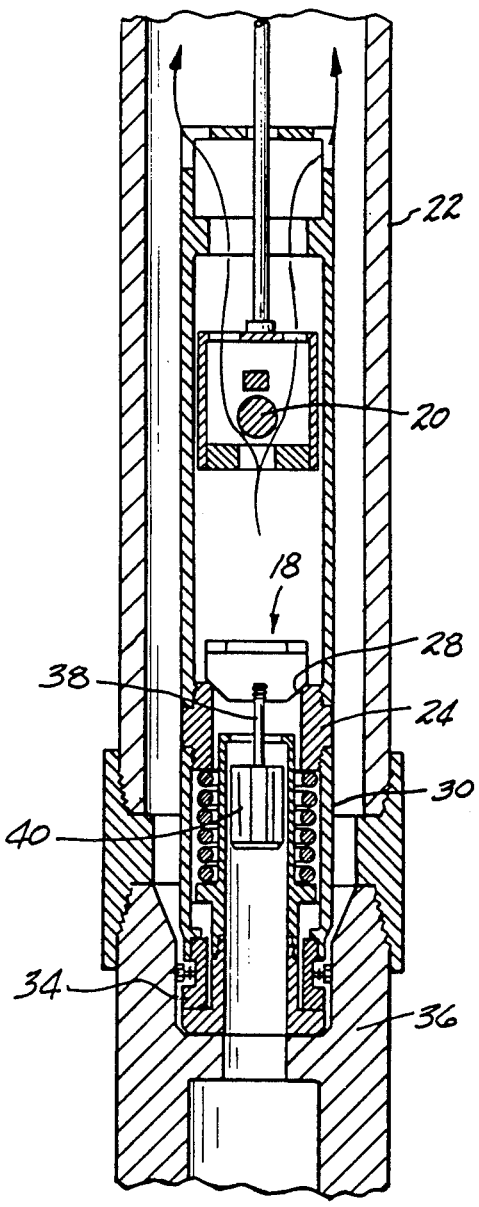
FIG. 4 is a partial cross sectional view similar to FIG. 3 showing the position of the inlet valve of the present invention on the downward stroke of the pump plunger.

When maintenance of the well is complete and pumping from the well is again desired the pump 10 is lowered via the suction rod 16 into seating nipple 36 wherein friction ring or sealing means 34 seals on the annular wall 62 of the seating nipple 36. Upon anchoring the pump within the seating nipple 36 flange 52 of the locking member 44 abuts the bottom surface 64 of the annular chamber defined in seating nipple 36. As can be seen in FIG. 2, as the pump is lowered the locking means 44 is pressed upward against the force of spring 54 and frees valve portion 40 thereby allowing the valve to act as a conventional check valve. As can be seen in FIGS. 3 and 4 on the upward stroke of the pump piston 14 the valve is moved upward so that element 28 unseals from valve seat 24 so as to draw fluid into the pump barrel 12. On the downward stroke (FIG. 4) the fluid is compressed in the pump barrel 12, the valve is closed as a result of compression of fluid in the barrel and outlet valve 20 provided in pump piston 14 opens allowing the fluid to pass from the pump barrel up the production tube 22.

Figure 5:
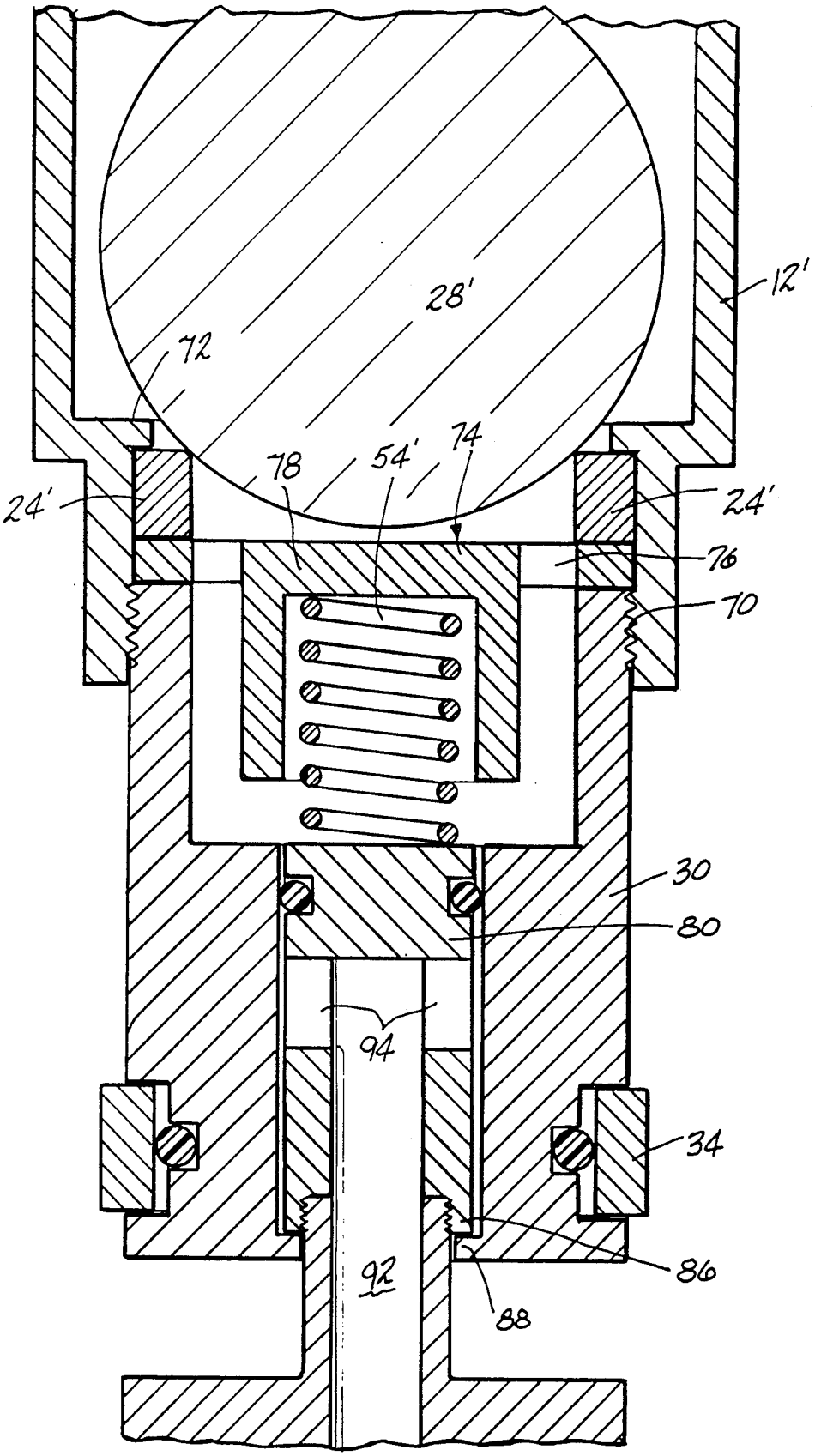
FIG. 5 is a cross sectional view of a second embodiment of an inlet valve in accordance with the present invention showing the valve in its locked position.
Figure 6:
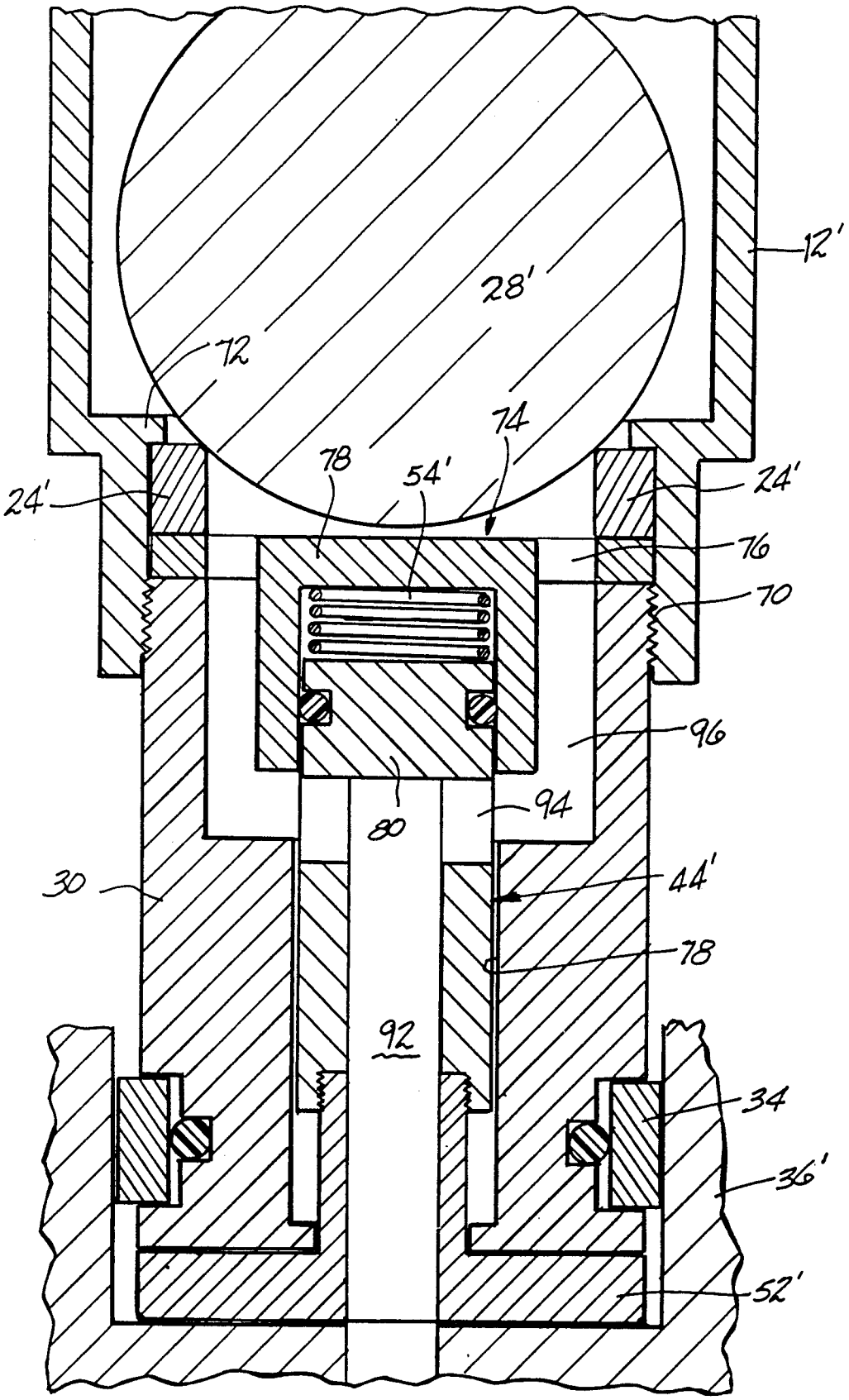
FIG. 6 is a further cross sectional view of the valve of FIG. 5 showing the inlet valve in its unlocked position.

FIGS. 5 and 6 illustrate a second embodiment inlet valve assembly in accordance with the present invention. With reference to FIG. 5, the pump barrel 12' has secured thereto by means of threads 70 an extension 30' which carries friction ring or seals 34' in a manner similar to the embodiment discussed above with regard to FIGS. 1 through 4. The pump barrel 12' is provided with a rib extension 72 on which a valve seat 24' rests. The valve seat 24' is held against rib 72 by cage member 74 which includes ports 76 for communicating fluid to the interior of pump barrel 12' via valve sealing element 28'. Cage member 74 is held against valve seat 24' by extension member 30' which is screwed to the valve barrel 12' by threads 70 as noted above. The cage member 74 is provided with a receptacle 79 which receives spring element 54'. Locking member 44' is mounted within bore 78 of extension element 30'. Locking member 44' includes on one end thereof a piston element 80 provided with annular recess 82 in which seal 84 seats. Piston 80 is contacted by spring 54' for biasing the locking member 44' in the downward direction where intermediate rib portion 86 abuts annular ridge 88. In this position the piston 80 is sealed within passage 78 thereby prohibiting flow of fluid up hollow conduit 92 in locking element 44' and radial passages 94 to valve sealing element 28'. Thus, in the position shown in FIG. 5 locking element 44' insures that no fluid from the well bore reaches the valve element 28' and thereby insures no fluid flows into the pump barrel 12'. The position of the valve in FIG. 5 is that position which the valve will assume when the pump is suspended in the production tube as discussed above with reference to FIG. 1.

Upon seating of the pump in seating nipple 36' the valve of FIG. 5 assumes the position illustrated in FIG. 6. As discussed above with regard to FIG. 2, element 52' on locking member 44' abuts the seating nipple and accordingly compresses spring 54' upon anchoring of the valve pump within the seating nipple as shown in FIG. 6. The compression of the spring element 54 allows the ports 94 to communicate with annular chamber 96 and thereby allows fluid to pass up through conduit 92 into annular chamber 96 through ports 76 to the valve sealing element 28'. In this position the valve now functions as a conventional check valve and will open and close in the same manner as discussed above with regard to FIGS. 3 and 4.

Figure 7:
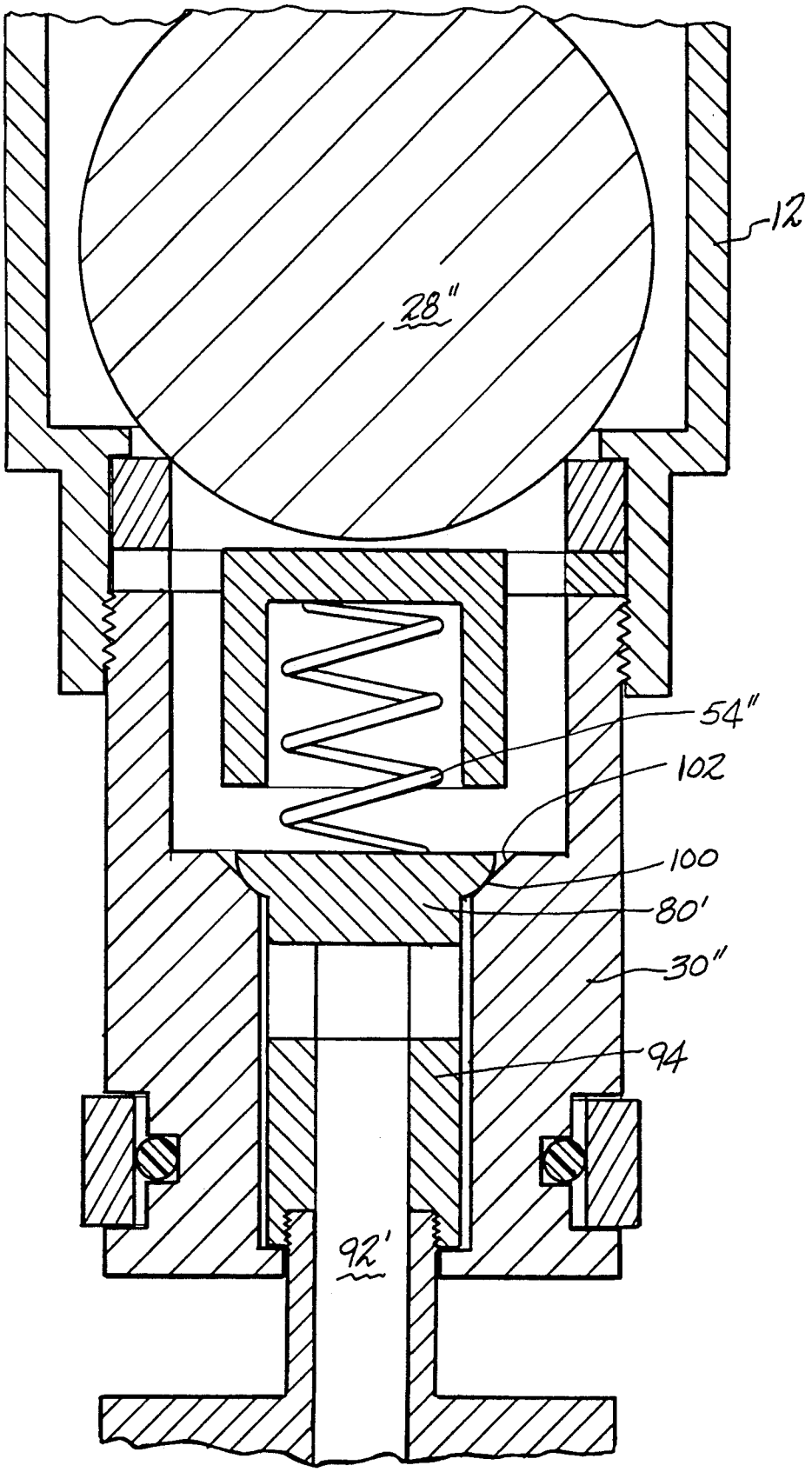
FIG. 7 is a cross sectional view of a third embodiment of an inlet valve in accordance with the present invention shown in its locked position.
Figure 8:
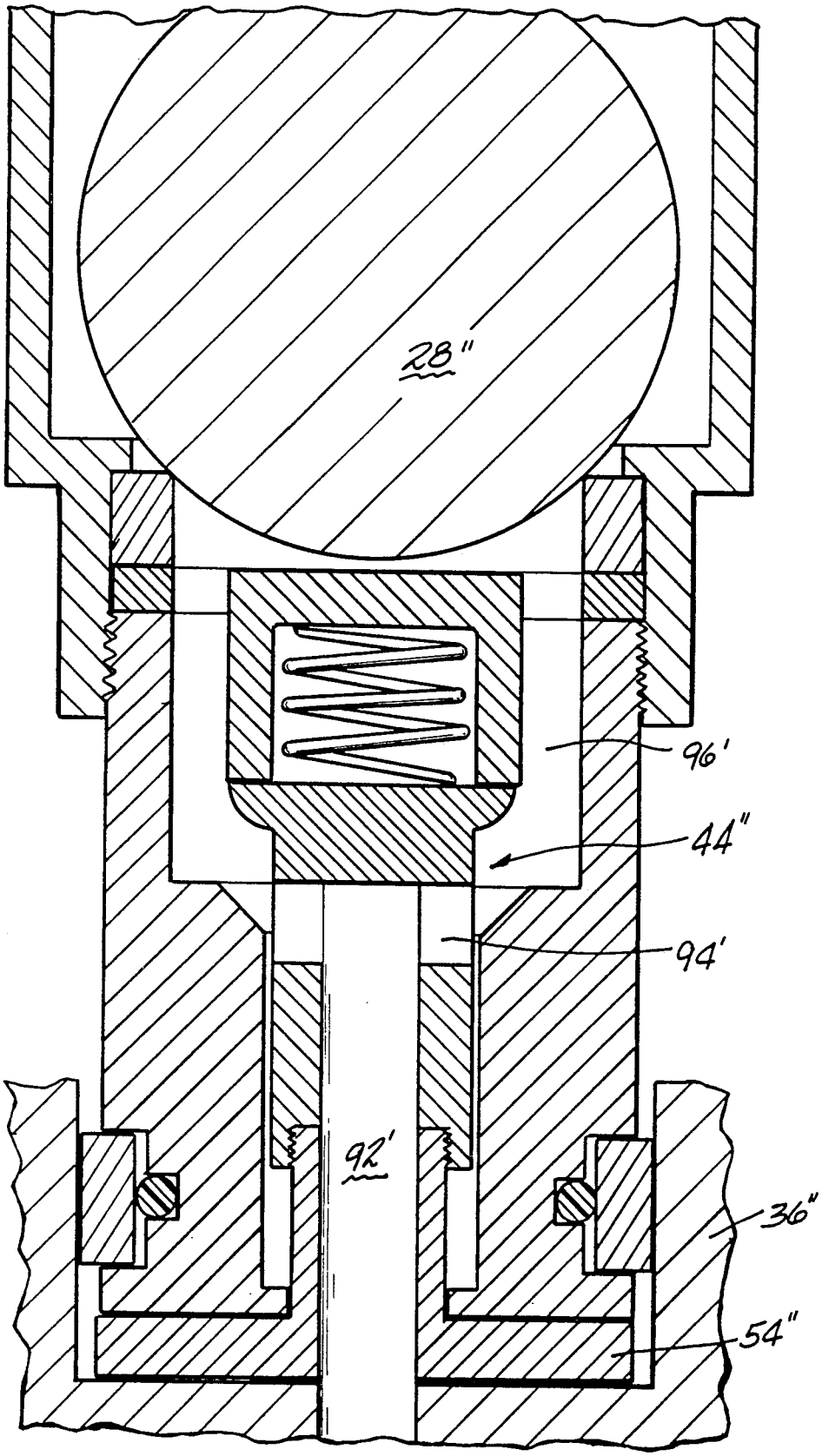
FIG. 8 is a cross sectional view of the inlet valve of FIG. 7 shown in its unlocked position.

FIGS. 7 and 8 illustrate a third embodiment of inlet valve in accordance with the present invention. The inlet valve of FIGS. 7 and 8 is similar construction to that of the inlet valve assembly FIGS. 5 and 6 discussed above. In the embodiment of FIGS. 7 and 8, the locking mechanism is provided with a piston portion 80' which has a sealing radial peripheral surface 100 adapted to seal on sealing surface 102 provided in extension portion 30''. Accordingly, as can be seen in FIG. 7, when the pump is in its unanchored position within the production tube the spring element 54'' biases piston portion 80' downwards so that it seals on sealing surface 102 thereby preventing flow of fluid up through conduit 92' and into annular space 96'. In this matter it is insured that fluid cannot pass through inlet valve seating element 28'' and into the pump barrel 12''. When the pump is anchored within seating nipple 36'' of the production tube, element 54'' of the locking mechanism 44'' abuts the seating nipple and thereby compresses spring 54'' so as to establish communication between conduit 92' and annular chamber 96' via ports 94' provided in locking element 44''. Thus, as was the case with the embodiments discussed above, when the pump is anchored within the seating nipple the valve assembly of the present invention acts as a normal check valve for pumping fluid from the deep well in the manner previously discussed with regard to FIGS. 3 and 4.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a deep well having a production tube and a sucker rod operated reciprocating subsurface pump which is selectively positioned between a first position wherein said pump is anchored in said production tube for pumping fluid from the well and a second position wherein said pump is unanchored in said production tube for non-pumping operations wherein said pump comprises a pump barrel having first valve seat defining an inlet port and a second valve seat defining an outlet port, an inlet valve for selectively sealing said inlet port and an outlet valve for selectively sealing said outlet port and a plunger reciprocally mounted within said pump barrel for pumping fluid from said inlet port to said outlet port, the improvement which comprises said inlet valve includes means for locking said inlet valve against said inlet port for sealing same against pressure downhole in the well when said pump is in said second position so as to prohibit passage of fluid into said pump barrel and unlocking said inlet valve so as to allow for selective sealing and unsealing of the inlet port when said pump is in said first position for pumping fluid from said well.

2. A system according to claim 1 wherein said production tube includes a seating nipple for anchoring said pump within said production tube when in said first fluid pumping position.

3. A system according to claim 2 wherein said means for locking includes biasing means for mechanically biasing said inlet valve against said inlet port.

4. A system according to claim 3 wherein said biasing means includes a collar which surrounds a portion of said inlet valve and spring means located between said valve seat and said collar for locking said inlet valve against said inlet port for sealing same.

5. A system according to claim 4 wherein said collar includes an abutment means for abutting said seating nipple when said pump is in said first position for compressing said spring means and unlocking said inlet valve.

6. A system according to claim 5 wherein a hollow extension is located upstream of said inlet port and said collar is biasly mounted within said hollow extension.

7. A system according to claim 6 wherein the hollow extension is provided with sealing means for sealing said pump in said first anchored pumping position within said sealing nipple.

8. A system according to claim 4 wherein said inlet valve comprises a first portion for sealing said inlet valve port and a second portion spaced from said first portion which is surrounded by said collar.

9. A system according to claim 1 wherein said sucker rod and said pump barrel are provided with engagement means for selectively fixing said pump barrel to said sucker rod for selectively positioning said pump between said first position and said second position.

* * * * *